United States Patent [19]

des Garets

[11] 3,993,251

[45] Nov. 23, 1976

[54] MANUAL PRESSURE SPRAYER

[76] Inventor: Christian des Garets, 52 av de Saxe, 75015 Paris, France

[22] Filed: June 27, 1975

[21] Appl. No.: 591,154

[52] U.S. Cl. ..... 239/579; 222/402.13

[51] Int. Cl.[2] ..... B05B 1/02

[58] Field of Search ..... 239/573, 579, 355, 333; 222/182, 402.13, 402.17

[56] References Cited

UNITED STATES PATENTS

| | | | |
|---|---|---|---|
| 3,209,953 | 10/1965 | Nichol | 222/182 |
| 3,408,010 | 10/1968 | Fukui | 239/355 X |

FOREIGN PATENTS OR APPLICATIONS

| | | | |
|---|---|---|---|
| 1,273,225 | 8/1961 | France | 222/402.13 |

*Primary Examiner*—Evon C. Blunk
*Assistant Examiner*—Michael Mar
*Attorney, Agent, or Firm*—Cushman, Darby & Cushman

[57] ABSTRACT

A spraying device such as a perfume dispenser or a lighter for smoking materials comprises a case surrounding a container of the liquid to be sprayed and carrying an internal finer-actuated slide which when moved by the user's finger depresses a pump plug which closes the container. The pump plug is provided with a spray orifice which in the depressed position of the plug is in register with a spray aperture in the case. In the at-rest position of the slide and pump plug, the spray aperture is closed by a screen. Movement of the slide to its spraying position moves the screen so as to align an aperture therein with the spray orifice and the spray aperture.

5 Claims, 7 Drawing Figures

10
11
12
13
14
15
16
17
18
19
20
21
22
23
24
25
d

MANUAL PRESSURE SPRAYER

Liquid sprayers have been well known for a long time, such as for eau-de-Cologne, lavander water, perfume etc., in which the spraying of the scent is obtained by manual squeezing of a rubber bulb; these sprayers only work satisfactorily when they are of relatively large size, and so they are not very aesthetic.

Some attempts have been made to create miniature sprayers which can be contained in a lady's hand bag; particularly, atomizer cases have been proposed in which, the liquid being under pressure, it is only necessary to depress a button which, after a very small stroke, causes the opening of a valve and the spraying of the liquid out of a small side orifice. The prior embodiments are still a little bulky and it is necessary to hold them with the whole hand and to depress the button which a finger of this hand; the button being often disposed within a recess of the case, it is not very accessible to the fingers of women with long nails.

Accordingly, it is an object of the present invention to provide a manual pressure sprayer which, although of small size, can be held for instance between the thumb and the second finger and actuated by the forefinger of this hand, without a risk of damaging the nail.

It is another object of the present invention to provide a case for liquid spraying, particularly a miniature case, wherein the bottom of the case bears a liquid bottle closed by a pump plug, and above this bottle and apart from it in a home position, is disposed a slide actuated by the user's finger engaged in an aperture through the case, the slide urging the pump and spraying out the liquid when three apertures, movable one with another in parallel and adjacent planes, are registered each with another as a result of the slide stroke.

Figures 1, 2, 3, 4:
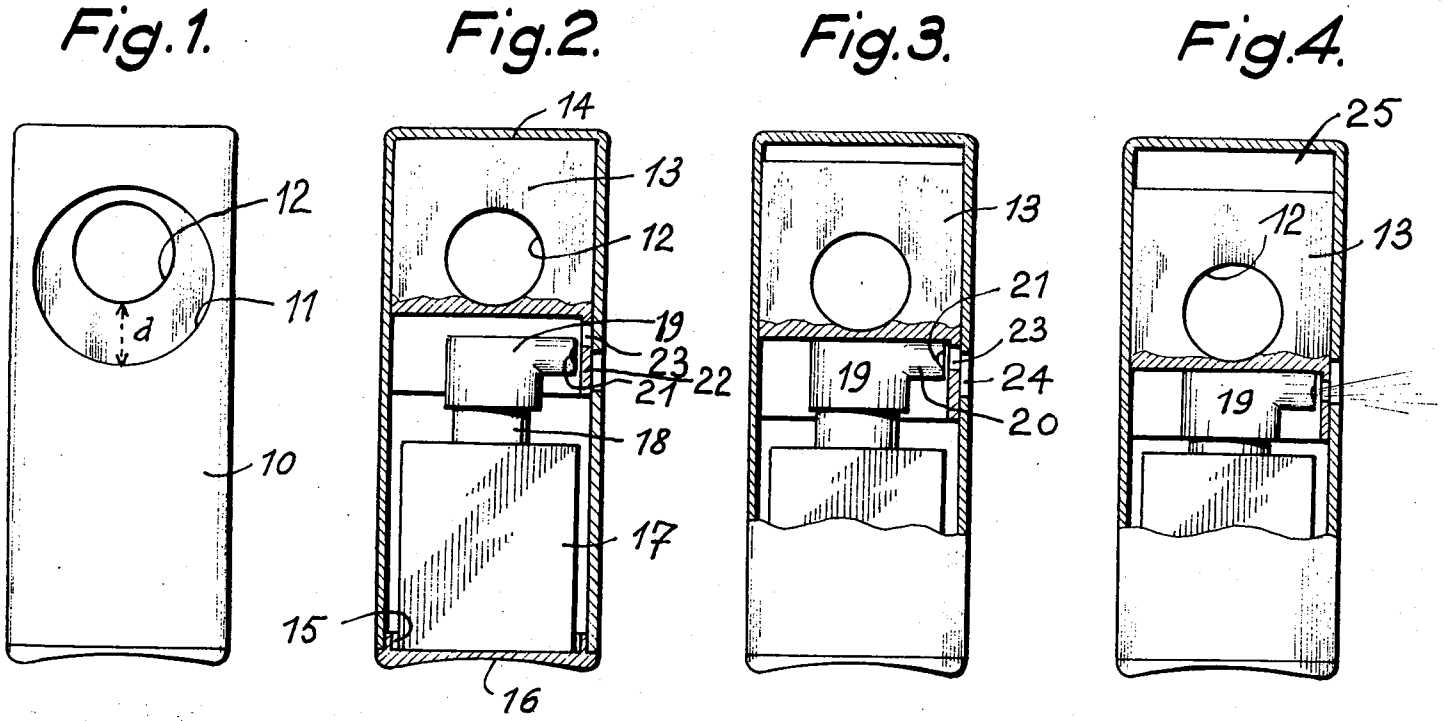
Figure 5:
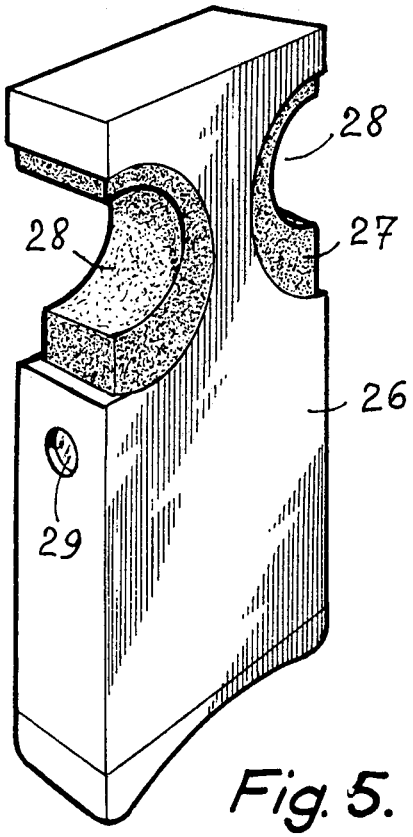
Figure 6:
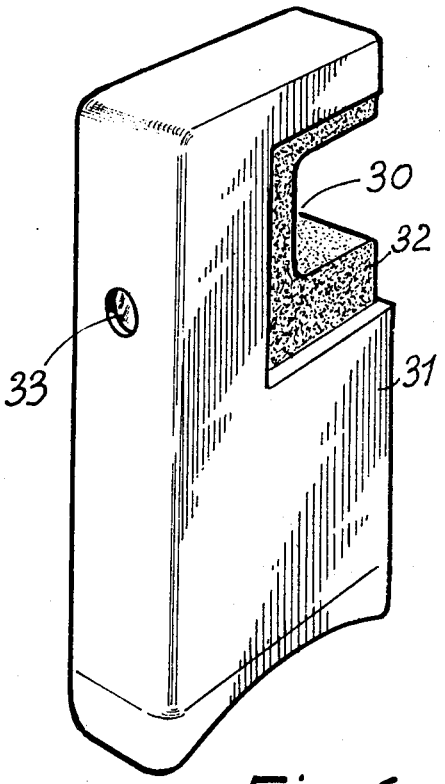
Figure 7:
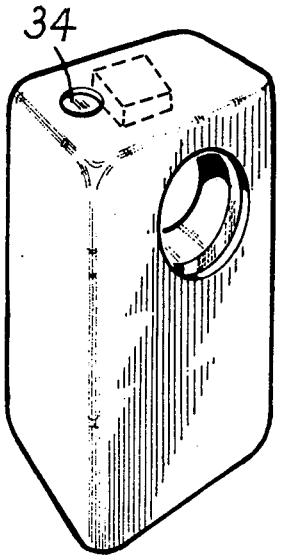

Other new features of this invention will become understood by reference to the following description, when read in conjunction with the accompanying drawings wherein:

FIG. 1 is an outside front view in elevation, of a minature case, for instance to spraying parfum, FIG. 2 is a fragmentary sectional view of the inside of this case, FIG. 3 is a view like FIG. 2 after partially downward stroke of the actuated slide, FIG. 4 is a view like FIG. 2 at the end of the downward stroke of the slide, with liquid spraying, FIGS. 5 and 6 are perspective views of alternative embodiments of the case, and FIG. 7 is a perspective view of another embodiment, in the case of a lighter.

As shown in FIG. 1, the case 10 in the shape of flat parallelipiped includes a large and circular through bore 11; within this bore we can see another circular bore 12 through the actuating slide; this bore is off centred upward from the first named bore, and its diameter is such that it is possible to readily engage the forefinger or another finger which protrudes on another side of the case, and can cause by pressure, the necessary downward stroke of the slide; at the end of the stroke, the finger rests on the bottom of the bore 11.

FIG. 2 shows the slide 13 with its bore 12, at the at-rest or home position; the slide which is adjusted with the inner cross-section of the case, rests against the upper side 14 thereof; below this slide, and held in an appropriate recess 15 in the bottom 16 of the case is a container such as a small bottle 17 which contains the liquid to be sprayed; the neck of this bottle is closed by a pump plug 19 the upper flat surface of which is spaced from the slide 13 when the latter is in its home position.

The pump plug 13 is extended with a lateral cylindrical protuberance 20 terminating in an orifice 21 in inside communication with the liquid in the bottle; moreover, integrally with the slide downward in front of the protuberance 20 and sliding against the slide wall of the case, is a small screen 22 with an aperture 23 which, in the home position, is above the orifice 21; on the other hand, this side wall of the case includes a relatively large aperture 24 which is closed in the home position of the slide 13 by a solid part of the screen 22.

This spraying case operates as follows:

The user engages sufficiently his finger within the bore 12 and depresses the slide 13; this one moves downward with the screen 22 and when it comes against the pump 19, the dimensions are such that the orifice 21 is substantially before the center of the aperture 23 (FIG. 3); when the pressure proceeds, the piston of the pump penetrates and, at a time, the orifice 21 and the apertures 23, 24 are registered each with another (FIG. 4) and the air pressure in the bottle causes at the same time the spraying of the liquid out of the case; at this time, the bottom of the aperture 12 is substantially tangential to the aperture 11 and then the stroke of the slide is shown in the FIG. 1 by the distance *d* between the two circles 11 and 12.

Since the slide 13 is shaped to conform with the inner cross-section of the case, there is created in the position shown in FIG. 4, some lowering of the pressure within the chamber 25 above the slide. The result is that if the slide 13 is now released by removing the finger, the atmospheric pressure below the slide 13, combined with the slight overpressure in the bottle automatically returns the slide 13 to its home position, as in FIG. 2, with the upward moving of the piston and cut off of the spraying.

The working of the apertures and closing device which cause the spraying is established in such a way that the passageway to the outside is only fully provided when the spraying pressure is reached. It is easy to provide slight structural alterations which give this result.

The FIGS. 5 to 7 are perspective views of alternative embodiments of cases which meet the same requirement.

FIG. 5 shows the case 26 and the slide 27 which include semi-circular apertures 28, the concavities of which are disposed above the spraying aperture 29, and the slide can be actuated by one or two fingers acting simultaneously. This disposition is useful for larger size cases.

FIG. 6 shows a single lateral aperture 30 of four-angled shape in the case 31 and the slide 32, on the side facing the spraying aperture 33.

The device of the present invention can however be useful for lighters, as shows FIG. 7; in this case, the spraying aperture 34 is shifted on the upper side of the case and the slide must actuate, simultaneously with the spraying, a known device 36 for generating sparks to ignite the spray.

The various cases which are described above are of the flat type, but it is understood that the invention is readily applicable to cases of cylindrical shape with a circular or oval base, or of any other shape.

What is claimed is:

1. A device for spraying liquid comprising:

a case having a wall provided with a spray aperture; a container of the liquid to be sprayed located inside said case, said container being closed by a pump plug which is movable between an at-rest position and a spraying position, said pump plug having a discharge orifice which in the spraying position of said pump plug is in register with the spray aperture; a slide located inside said case, said slide being movable between an at-rest position and a spraying position in which the slide has engaged and moved said pump plug to its spraying position, said slide being capable of actuation by the user's finger engaged in a finger aperture in said case; and a screen disposed between said pump plug and the spray orifice, said screen having an aperture therethrough and being in sliding engagement with the wall of said case which is provided with said spray aperture, said screen being movable by said slide such that when said slide and said pump plug are in their spraying positions, the aperture in said screen is in register with the spray orifice and with the spray aperture and said screen having a solid portion which is disposed between the spray orifice and the spray aperture when said slide and pump plug are in their at-rest position.

2. A spraying device as in claim 1 wherein the finger aperture in said case is cylindrical and wherein said slide is provided with a cylindrical aperture of smaller diameter than the finger aperture whereby the stroke of the slide is determined by the distance between the aperture in said slide and the wall of the aperture in said case.

3. A spray device as in claim 1 wherein said slide is complementary with the inside of the case so as to form a chamber between the case and the surface of said slide remote from said pump plug whereby movement of said slide toward its spraying position reduces the pressure in said chamber so as to aid automatic return of said slide to its at-rest position when said slide is released from finger pressure.

4. A spray device as in claim 1 wherein said case is of elongated shape having side walls and end walls and wherein the spray aperture is located in one of the side walls.

5. A spray device as in claim 1 wherein the liquid in said container is flammable, said device including a spark generator actuated by said slide for igniting the spray.

* * * * *